US008678114B1

(12) United States Patent
Akre

(10) Patent No.: US 8,678,114 B1
(45) Date of Patent: Mar. 25, 2014

(54) POWER WHEELCHAIR WITH GUARD FOR PLAYING SPORTS

(71) Applicant: Brian K. Akre, Zimmerman, MN (US)

(72) Inventor: Brian K. Akre, Zimmerman, MN (US)

( * ) Notice: Subject to any disclaimer, the term of this patent is extended or adjusted under 35 U.S.C. 154(b) by 0 days.

(21) Appl. No.: 13/664,783

(22) Filed: Oct. 31, 2012

(51) Int. Cl.
*A61G 5/04* (2013.01)

(52) U.S. Cl.
USPC ..... 180/54.1; 180/6.2; 180/6.48; 180/6.5; 180/65.1; 180/65.51; 180/907

(58) Field of Classification Search
USPC ..... 180/6.2, 6.48, 6.5, 65.1, 65.51
See application file for complete search history.

(56) References Cited

U.S. PATENT DOCUMENTS

| | | | | |
|---|---|---|---|---|
| 6,341,657 | B1 * | 1/2002 | Hopely et al. | 180/6.5 |
| 6,938,923 | B2 * | 9/2005 | Mulhern et al. | 280/755 |
| 2010/0051357 | A1 * | 3/2010 | Kessler | 180/2.1 |

* cited by examiner

*Primary Examiner* — Hau Phan
*Assistant Examiner* — Bryan Evans
(74) *Attorney, Agent, or Firm* — Dave Lingbeck

(57) ABSTRACT

A power wheelchair with guard for playing sports for eliminating G-Force effects and improving safety. The power wheelchair with guard for playing sports includes a frame assembly; a mobility system including drive wheels and casters upon which the frame assembly is mounted and also including a motor and a power control module for actuating the drive wheels; a seat assembly being secured to the frame assembly and including a seat support member and a seat; and a guard assembly being attached to the frame assembly and extending forwardly thereof.

7 Claims, 3 Drawing Sheets

POWER WHEELCHAIR WITH GUARD FOR PLAYING SPORTS

CROSS-REFERENCE TO RELATED APPLICATIONS

The present application claims priority to the provisional application Ser. No. 61/686,300, filed on Apr. 3, 2012, the disclosure of which is expressly incorporated by reference herein in its entirety.

BACKGROUND OF THE INVENTION

1. Field of the Invention

The present invention relates to wheelchairs and more particularly pertains to a new power wheelchair with guard for playing sports for eliminating G-Force effects and improving safety.

2. Description of the Prior Art

The use of wheelchairs is known in the prior art. More specifically, wheelchairs heretofore devised and utilized are known to consist basically of familiar, expected and obvious structural configurations, notwithstanding the myriad of designs encompassed by the crowded prior art which have been developed for the fulfillment of countless objectives and requirements.

The prior art describes power wheelchairs that include higher positioned seat supports relative to the ground thus making the wheelchair top heavy and also include anti-tip casters which extend farther back from the drive wheels thus causing more obstructions and further include exposed wheels which results in the wheels becoming entangled with objects and possibly causing tilting of the wheelchairs. While these devices fulfill their respective, particular objectives and requirements, the aforementioned patents do not disclose a new power wheelchair with guard for playing sports.

SUMMARY OF THE INVENTION

The general purpose of the present invention, which will be described subsequently in greater detail, is to provide a new power wheelchair with guard for playing sports which has many of the advantages of the wheelchairs mentioned heretofore and many novel features that result in a new power wheelchair with guard for playing sports which is not anticipated, rendered obvious, suggested, or even implied by any of the prior art wheelchairs, either alone or in any combination thereof. The present invention includes a frame assembly; a mobility system including drive wheels and casters upon which the frame assembly is mounted and also including a motor and a power control module for actuating the drive wheels; a seat assembly being secured to the frame assembly and including a seat support member and a seat; and a guard assembly being attached to the frame assembly and extending forwardly thereof. None of the prior art includes the combination of the elements of the present invention.

There has thus been outlined, rather broadly, the more important features of the power wheelchair with guard for playing sports in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new power wheelchair with guard for playing sports which has many of the advantages of the wheelchairs mentioned heretofore and many novel features that result in a new power wheelchair with guard for playing sports which is not anticipated, rendered obvious suggested, or even implied by any of the prior art wheelchairs, either alone or in any combination thereof.

Still another object of the present invention is to provide a new power wheelchair with guard for playing sports for eliminating G-Force effects and improving safety.

Still yet another object of the present invention is to provide a new power wheelchair with guard for playing sports that lowers the center of gravity for the user to greatly enhance play by making the wheelchair more stable and thus speedier.

Even still another object of the present invention, is to provide a new power wheelchair with guard for playing sports that eliminates or at less reduces obstructions.

Further another object of the present invention is to provide a new power wheelchair with guard for playing sports that doesn't impede movement across thresholds as such.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
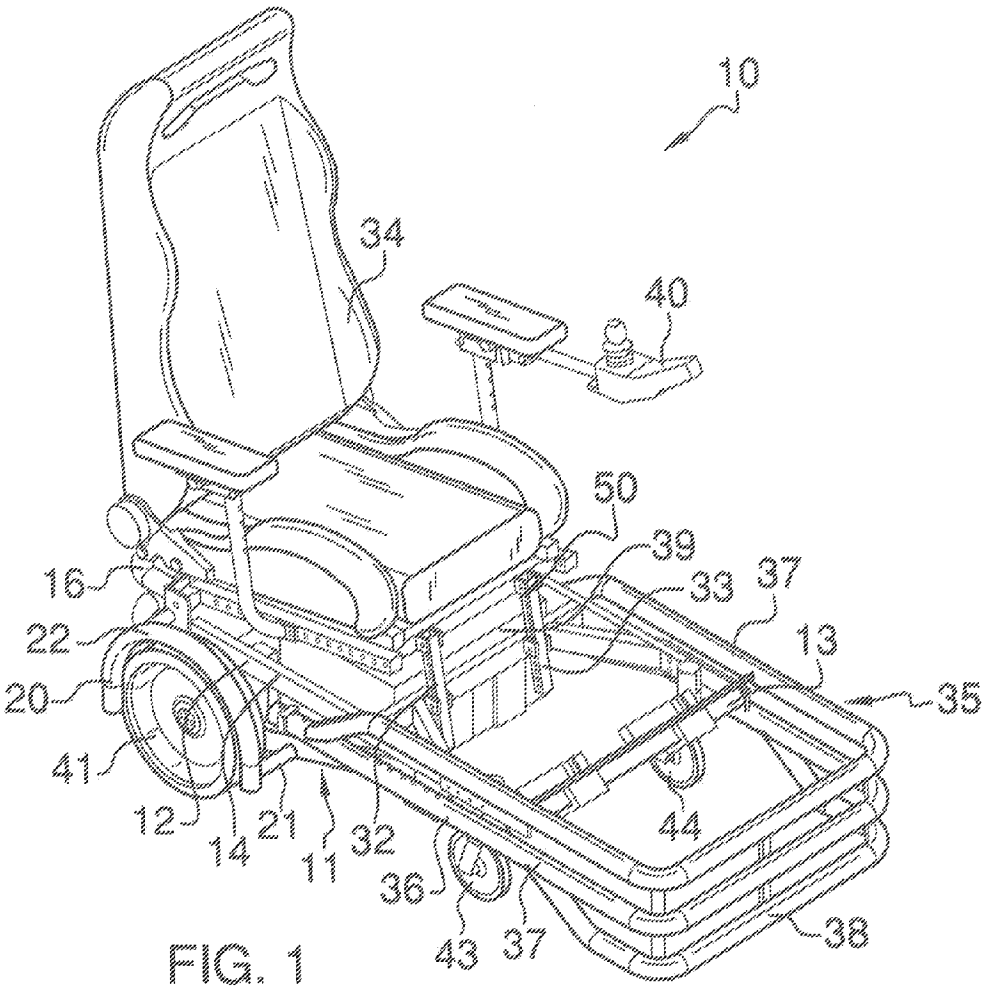
FIG. 1 is a front perspective view of a new power wheelchair with guard for playing sports according to the present invention.
Figure 2:
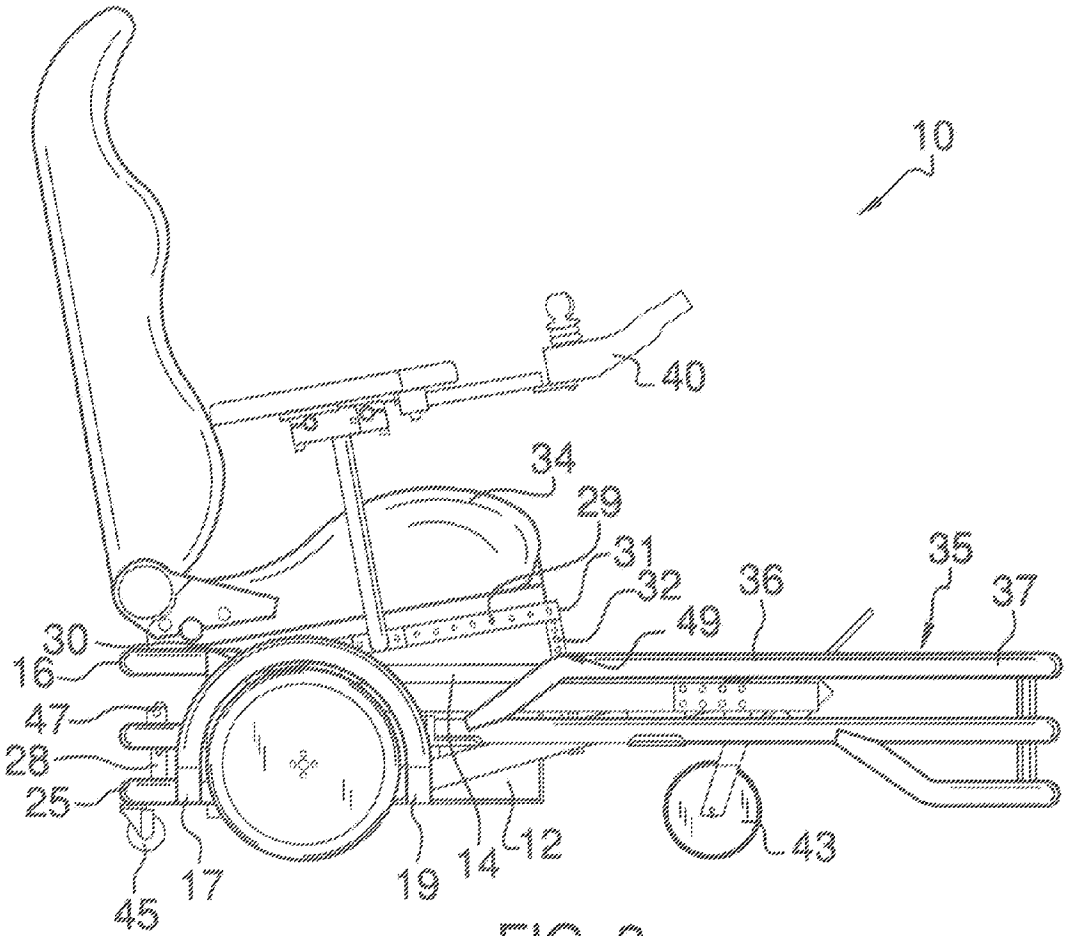
FIG. 2 is a side elevational view of the present invention.
Figure 3:
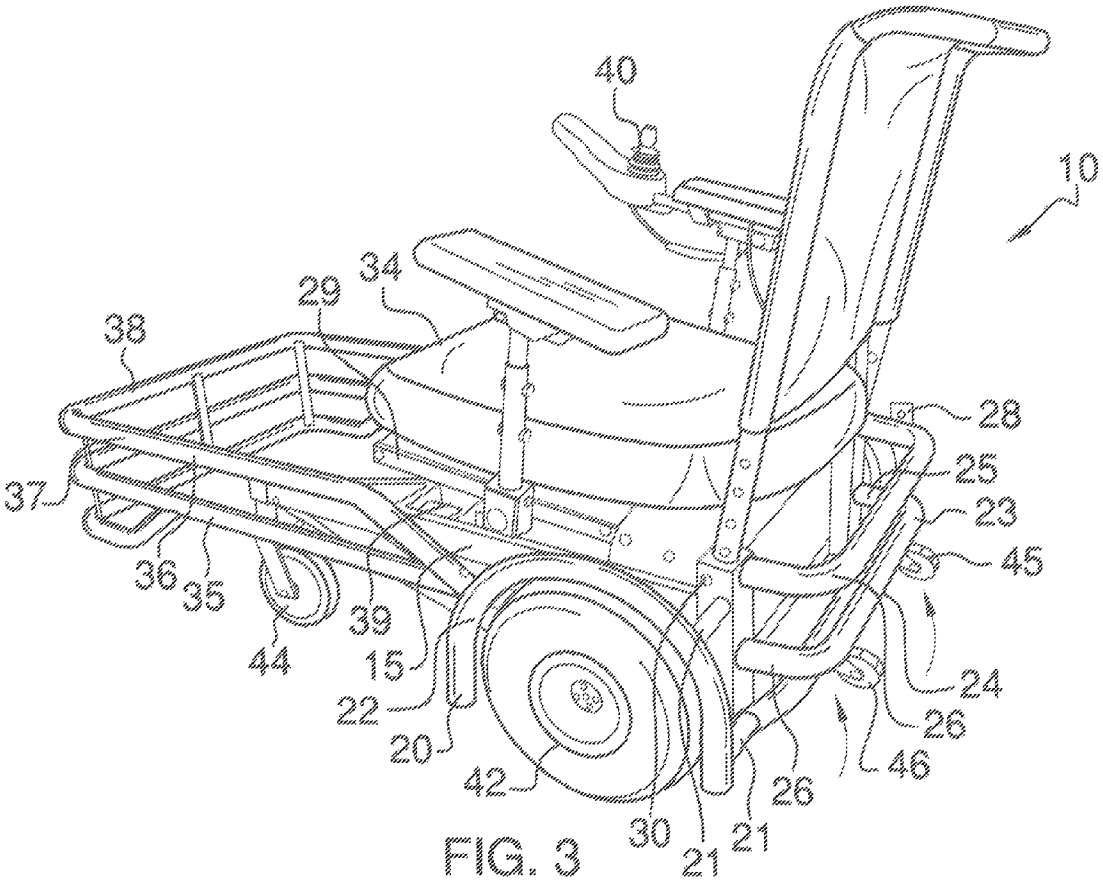
FIG. 3 is a rear perspective view of the present invention.

With reference now to the drawings, and in particular to FIGS. 1 through 3 thereof, a new power wheelchair with guard for playing sports embodying the principles and concepts of the present invention and generally designated by the reference numeral 10 will be described.

As best illustrated in FIGS. 1 through 3, the power wheelchair with guard for playing sports 10 generally comprises a frame assembly 11; a mobility system including drive wheels 41,42 and casters 43-46 upon which the frame assembly 11 is conventionally mounted and also including a motor 39 and a power control module 40 for actuating the drive wheels 41,42; a seat assembly being conventionally secured to the frame assembly 11 and including a seat support member 29 and a seat 34; and a guard assembly 35 being conventionally attached to the frame assembly 11 and extending forwardly thereof.

The frame assembly 11 includes a base frame 12 having a front 13, back 16 and sides 14,15, and also including wheel guards 17,20 being integrally attached and welded to the sides 14-15 of the base frame 12 and being extended about at least a portion of the drive wheels 41,42 to prevent the drive wheels 41,42 from riding up over objects and tipping over. Each wheel guard 17,20 includes stub-like guard attachment members 18,21 being conventionally attached and welded to a respective side 14,15 of the base frame 12 and extending outwardly therefrom and also includes an arcuate tubular member 19,22 being conventionally attached to the guard attachment members 18,21 and being circumferentially disposed over and about at least a portion of a respective drive wheel 41,42. The base frame 12 further includes an elongate caster support member 23 being pivotally attached at and forming a part of the back 16 of the base frame 12 and having a main portion 24 and curved end portions 25,26. The main portion 24 of the elongate caster support member 23 and the back 16 of the base frame 12 are disposed generally parallel to a line interconnecting the axes of the drive wheels 41,42 and are disposed rearwardly no more than 10 inches from the axes of the drive wheels 41,42 to eliminate or substantially reduce the back 16 of the base frame 12 from being an obstruction during the use of the power wheelchair 10 especially during the playing of sports. The frame assembly 11 also includes a bracket 28 being conventionally attached to the elongate caster support member 23 and further includes a fastener 48 to fasten the bracket 28 to the base frame 12 upon the elongate caster support member 23 being pivotally raised relative to a ground. The casters 43-46 include rear casters 45,46 conventionally depending from the elongate caster support member 23 and being raisable off the ground to facilitate mobility of the wheelchair across barriers such as thresholds.

The seat support member 29 has a rear end 30 which is pivotally and conventionally attached to the frame assembly 11 thus forming a pivot point. The back end 30 and the pivot point of the seat support member 29 is disposed less than 10 inches behind a vertical plane passing through the axes of the drive wheels 41,42 to substantially reduce the G-forces upon a user spinning the wheelchair since the user's body would be positioned lower relative to the ground and also would be more centered in regards to the axis of the spin. The back end 30 of the seat support member 29 is also disposed less than 15 inches above the ground to substantially stabilize the wheelchair. The seat support member 29 is substantially planar and has a length as measured from the back end 30 to a front end 31 thereof being less than but within 3 inches of a distance measured from a person's tailbone to the person's back of the knee to create stability for the user. The seat assembly further includes adjustable bracket members 32,33 being conventionally fastened to the base frame 12 and to the front end 31 of the seat support member 29 to raise, lower and support the front end 31 of the seat support member 29 relative to the ground and to the base frame 12. Each adjustable bracket member 32,33 has holes 49,50 being spaced along a length thereof for receiving fastening members to adjust the position of the front end 31 of the seat support member 29.

The guard assembly 35 also includes elongate guard members 36 which are essentially tubular members being conventionally attached to the base frame 12 and extending forward of the base frame 12 and also being proximate to the ground to prevent sports balls as such from getting under the guard assembly 35. Each elongate guard member 36 includes elongate side portions 37 extending forward of the base frame 12 and also includes an elongate front portion 38 interconnecting the elongate side portions 37.

In use, the user is positioned upon the wheelchair 10 more centrally in regards to the axis of the spin and lower to the ground to stabilize the wheelchair 10 and prevent it from being top-heavy and prone to tipping when especially being used in sporting events. The user will use the power control module 40 to move and maneuver the wheelchair 10 and will use the guard assembly 35 to strike a ball during play. As the user maneuvers the wheelchair 10 the back 16 of the base frame 12 is substantially shorter than that of other wheelchairs and thus causes little or no obstruction especially when the user needs to spin the wheelchair 10. Since the back 16 of the base frame 12 is disposed in close proximity to the drive wheels 41,42 the user can spin the wheelchair 10 and not come into contact with either the ball in play or other wheelchairs. In addition, the user can raise the rear casters 45,46 when moving over barriers such as thresholds where the rear casters otherwise can get hung up and prevent the wheelchair from moving.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the power wheelchair with guard for playing sports. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A power wheelchair with guard for playing sports comprising:

a frame assembly;

a mobility system including drive wheels and casters upon which said frame assembly is mounted and also including a motor and a power control module for actuating said drive wheels;

a seat assembly being secured to said frame assembly and including a seat support member and a seat; and a guard assembly being attached to said frame assembly and extending forwardly thereof, wherein the frame assembly includes a base frame having a front, back and sides, and also includes wheel guards attached to said sides of the base frame and extended about at least a portion of said drive wheels to prevent said drive wheels from riding up over objects and tipping over, wherein each said wheel guard includes guard attachment members attached to a respective said side of said base frame and extending outwardly therefrom and also includes an arcuate tubular member attached to said guard attachment members and circumferentially extend above and radially aligned with at least a portion of a respective said drive wheel.

2. A power wheelchair with guard for playing sports comprising:

a frame assembly;

a mobility system including drive wheels and casters upon which said frame assembly is mounted and also including a motor and a power control module for actuating said drive wheels;

a seat assembly being secured to said frame assembly and including a seat support member and a seat; and a guard assembly being attached to said frame assembly and extending forwardly thereof, wherein said base frame further includes an elongate caster support member pivotally attached at and forming a part of said back of said base frame and having a main portion and curved end portions, wherein said main portion of said elongate caster support member and said back of said base frame are disposed generally parallel to a line interconnecting the axes of the drive wheels and are disposed rearwardly no more than 10 inches from the axes of said drive wheels to better avoid obstructions and maneuver in tight areas, wherein said frame assembly also includes a bracket attached to said elongate caster support member and further includes a fastener to adjustably fastening said bracket to said base frame when said elongate caster support member is pivotably raised.

3. The power wheelchair with guard for playing sports as described in claim 1, wherein said seat support member has a back end which is pivotal attached to said frame assembly thus forming a pivot point.

4. The power wheelchair with guard for playing sports as described in claim 3, wherein said back end and the pivot point of said seat support member is disposed less than 10 inches behind a vertical plane passing through the axes of the drive wheels to substantially reduce the G-forces upon a user spinning the wheelchair and to position the user at the axis of the spin.

5. The power wheelchair with guard for playing sports as described in claim 3, wherein said back end of said seat support member is adapted to be disposed less than 15 inches above the ground to substantially stabilize the wheelchair.

6. The power wheelchair with guard for playing sports as described in claim 3, wherein said seat support member is substantially planar and is configured to have a length as measured from said back end to a front end thereof less than but within 3 inches of a distance measured from a person's tailbone to the person's back of the knee to create stability for the user.

7. The power wheelchair with guard for playing sports as described in claim 3, wherein said seat assembly further includes adjustable bracket members being fastened to said base frame and to said front end of said seat support member to raise, lower and support said front end of said seat support member relative to the ground and to the base frame, each said adjustable bracket member having holes being spaced along a length thereof for receiving fastening members to adjust the position of said front end of said seat support member.

* * * * *